United States Patent [19]

Ishii

[11] 4,378,887

[45] Apr. 5, 1983

[54] SPHERICAL FRUIT ASSORTING INSTRUMENT

[76] Inventor: Toru Ishii, 14-Go, 3-Ban, 4-Chome Takehata-Cho, Matsuyama-shi, Ehime-Prefecture, Japan, 790

[21] Appl. No.: 261,641

[22] Filed: May 7, 1981

[51] Int. Cl.[3] ..... B07C 5/06

[52] U.S. Cl. ..... 209/622; 209/681; 209/628

[58] Field of Search ..... 209/625, 627, 628, 621, 209/622, 623, 624, 681, 685

[56] References Cited

U.S. PATENT DOCUMENTS 1,242,573 10/1917 Matson ..... 209/623

3,561,597 2/1971 Youngblood ..... 209/622

FOREIGN PATENT DOCUMENTS 419723 11/1934 United Kingdom ..... 209/681

*Primary Examiner*—Allen N. Knowles

*Attorney, Agent, or Firm*—Bacon & Thomas

[57] ABSTRACT

The invention is concerned with an improved construction of an apparatus for assorting such spherical fruitage as oranges, apples and pears by each different size thereof, comprising a plurality of assorting plates vertically overlapped with each other, the uppermost plate being provided with the largest diameter assorting hole and successive lower plates having holes of decreasing diameter so that as the plates progress in operation, the lower plates are successively moved downwardly into different positions, thereby permitting the fruits to be assorted free of any damage which otherwise might affect the rind of the fruits by passing the fruit through each of the assorting holes.

5 Claims, 6 Drawing Figures

SPHERICAL FRUIT ASSORTING INSTRUMENT

BACKGROUND OF THE INVENTION

Most of the conventional type fruit assorting instruments in present use are provided with a plurality of cylinders having diametrally different throughholes on circumferentially suitable surface thereof disposed in parallel, starting with a cylinder having the smallest diameter holes and ending with a cylinder having the largest diameter holes, wherein spherical fruits to be assorted are conveyed on the rotating cylinders and permitted to fall down through the holes onto a moving conveyor belt provided internally of each clyinder.

There is another type of fruit assorting instrusment wherein a plurality of supporting elements are disposed on plane surface to form thereon assorting holes so disposed that when fruits to be assorted are being conveyed on the plane surface, said holes are diametrally enlarged in succession by winding the supporting elements, whereby the fruits are permitted to pass through the holes to each different position in sequence of size.

Referring to the foregoing cylinder type fruit assorting instruments, however, they are disadvantageous in that fruits to be assorted must be repeatedly rolled directly on the moving cylinders so that, the larger the fruits are, the more often they are forced to roll along the cylinders on the midway before reaching the last cylinder, resulting in the fruits being excessively damaged. Further referring to the plane surface type fruit assorting instrument, it has great disadvantages in that it is quite complicated in structure and expensive to manufacture and further characterized by difficulty in predetermining the diameter of the assorting holes.

STATEMENT OF OBJECTS

Accordingly, the present invention has been made to eliminate or mitigate all the above-mentioned drawbacks and disadvantages, having as one of its main objects the provision of a spherical fruit assorting instrument wherein a plurality of assorting plates provided with diametrally different throughholes are overlapped with each other so as to move downwardly from an auxiliary receiving plate positioned just below each of said plates while fruits to be assorted are being conveyed whereby the fruits can be held stationary within said throughholes, quite free of impacts and vibrations which otherwise might seriously damage the fruits.

Another object of the invention is to provide a spherical fruit assorting instrument wherein a main assorting plate body is composed of assorting plate members having in the lowermost end thereof particular auxiliary receiving plates without assorting throughholes whereby some of the fruits to be assorted, even if moved along with the movement of the assorting plates and caught into the holes thereof, can be forcibly brought into contact with the auxiliary receiving plates and pushed through the holes rearwardly of the direction in which they are to be conveyed.

Another object of the invention is to provide a spherical fruit assorting instrument which has shock-absorbing elements disposed in the position corresponding to the holes of each assorting plate and also stopper means for holding the auxiliary receiving plates in a vertical disposition so that such plates are secured against movement even when forcibly contacted by the fruits that have fallen down through the holes of each moving cylinder, thereby pushing the fruits out of the holes to bring same into contact with the shock-absorbing elements.

Another object of the invention is to provide a spherical fruit assorting instrument wherein the assorting plates include reduction means that move the plates downwardly at a lower rate of speed than the fruits to be assorted falling under gravity whereby even if the fruits should come down to said auxiliary receiving plates or the assorting plates that are being held vertically plumb after coming down, they are completely prevented from being held between these plates.

A further object of the invention is to provide a spherical fruit assorting instrument that has a pressing means adapted to forcibly press some downward moving assorting plates against the auxiliary receiving plates or other assorting plates that have just come down in priority so that even if the fruits happen to be clogged into the assorting holes of the assorting plates, they are forcibly pressed against the shock-absorbing elements of the auxiliary receiving plates whereby all the fruits can be exactly assorted into each pre-determined size.

A still further object of the invention is to provide a spherical fruit assorting instrument having assorting plates provided with throughholes each of which is adapted to be supplied with each of the fruits to be assorted, thereby preventing the fruits from being placed on assorting plates which are not provided with said throughholes and permitting the fruits to be efficiently assorted.

These and other objects, features and advantages of the invention will become apparent from the following detailed description of the invention when taken in conjunction with the accompanying drawings, in which.

Figure 1:
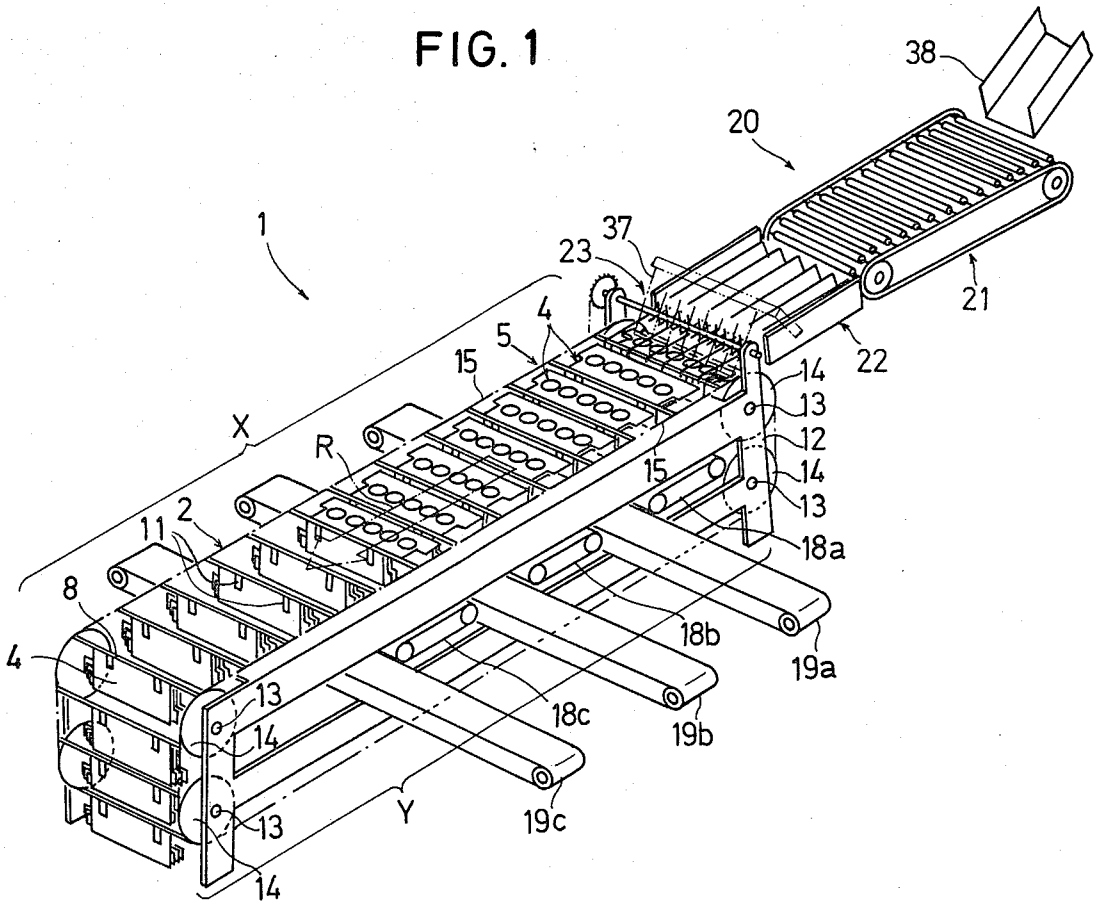
FIG. 1 is a perspective view showing an entire spherical fruit assorting instrument in accordance with the present invention.

Setting forth now in detail the spherical fruit assorting instrument of the invention with reference to the accompanying drawings, reference numeral 1 generally designates a main assorting instrument body. Said body 1 comprises an endless conveyor belt 2 for assorting spherical fruits 3, such as oranges, apples and pears, into each different size.

Across the length of said main assorting instrument body 1 there are a plurality of assorting plates 4 disposed in parallel, comprising assorting plate members 4*a*, 4*b* and 4*c* which abut against fruits 3 to be assorted.

Said assorting plates 4 are conveyed along an elliptic course and by endless conveyor 2 or chains 5. Further, assorting plate members 4*a*, 4*b* and 4*c* are adapted to be sustained by means of guide means 6 which are provided internally of said chains 5 thereby being selectively held horizontally in downward unmovable relation but permitted to move downward in each different position.

Figure 4:
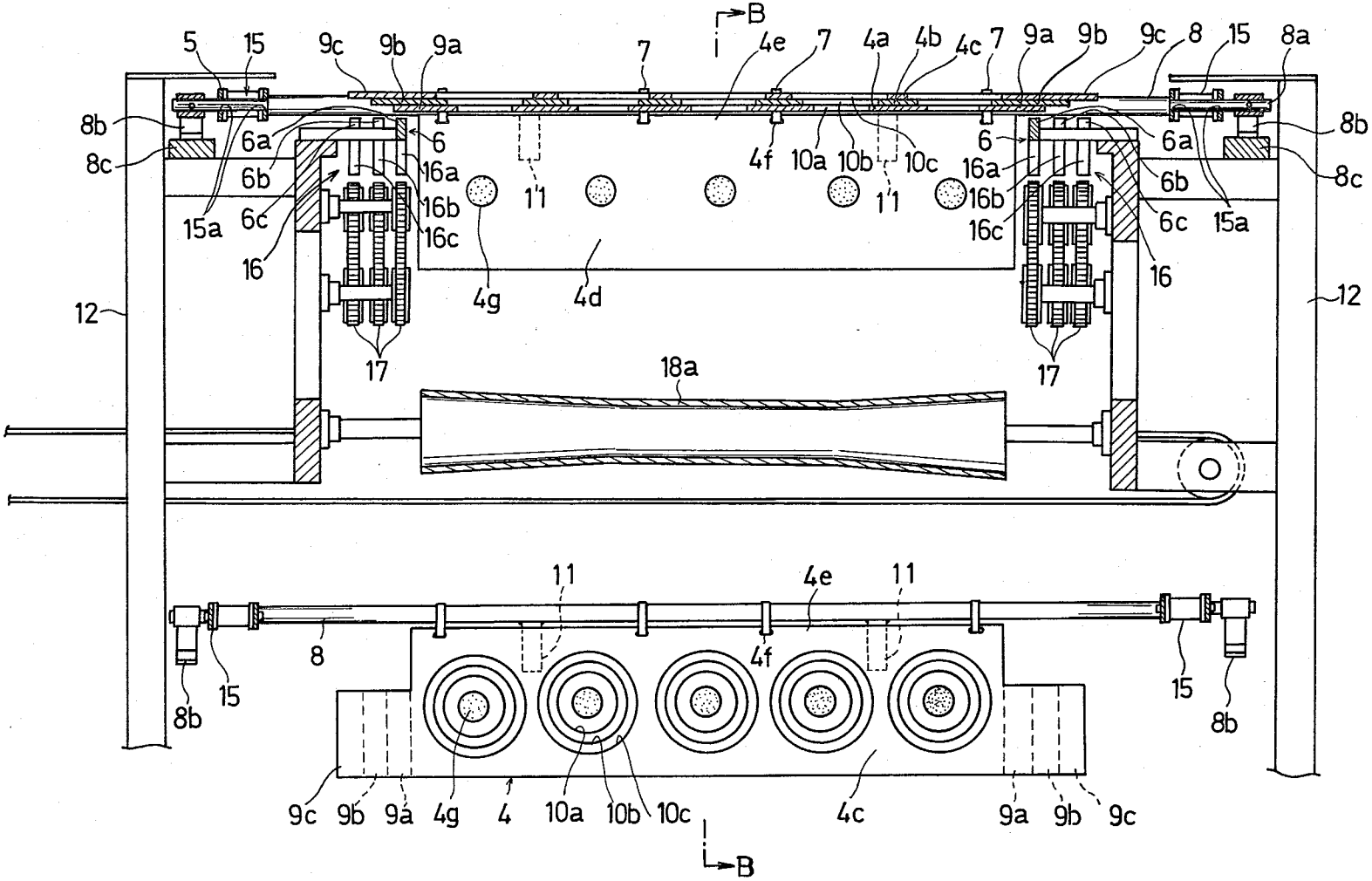
FIG. 4 is an enlarged view taken on the line A—A of FIG. 2.

The assorting plate members 4*a*, 4*b* and 4*c* and said auxiliary receiving plate member 4*d* are prefereably made of metallic or synthetic resin material, with one edge 4*e* thereof having holes 4*f* held by means of a ring 7 in movable relation about an axis 8 as clearly shown in FIG. 4.

On both edges rearward of said assorting plate members 4*a*, 4*b* and 4*c* there are provided projections 9*a*, 9*b* and 9*c* respectively in integral relation with said edges, which projections extend outwardly in correspondence with the order in which the plates are vertically positioned.

Further on said both edges there are assorting throughholes 10*a*, 10*b* and 10*c* in vertically corresponding and coaxial relation with each other at suitably spaced apart intervals, which throughholes have successively larger diameters from the lowermost to the uppermost plate.

In each position of said auxiliary receiving plate 4*b* corresponding to said throughholes 10*a*, 10*b* and 10*c* there is provided a shock-absorbing member 4*g* made for example of sponge rubber material. On the axis 8 there is provided a stopper means 11 which prevents the auxiliary receiving plate 4*d* from moving toward the direction in which fruits 3 are to be conveyed and holds said plate 4*d* a vertical disposition.

Said endless conveyor belt 2 and chains 5 include a pair of rotary shafts 13 disposed in parallel at both sides of conveyor 2 forwardly and rearwardly thereof, a pair of sprocket wheels 14 mounted on the outer circumference of the rotary shafts 13 and chain means 15 mounted between two pairs of sprocket wheels at opposite ends thereof.

Between the chain means 15 there are placed the axes 8 of said assorting plates 4 at suitably spaced apart intervals, the extremities 8*a* of said axis 8, being rotatably inserted into holes 15*a* of the chain means 15, while guide arms 8*b* are protruded backwardly of the extremities 8*a* at a right angle with respect thereto.

Figure 2:
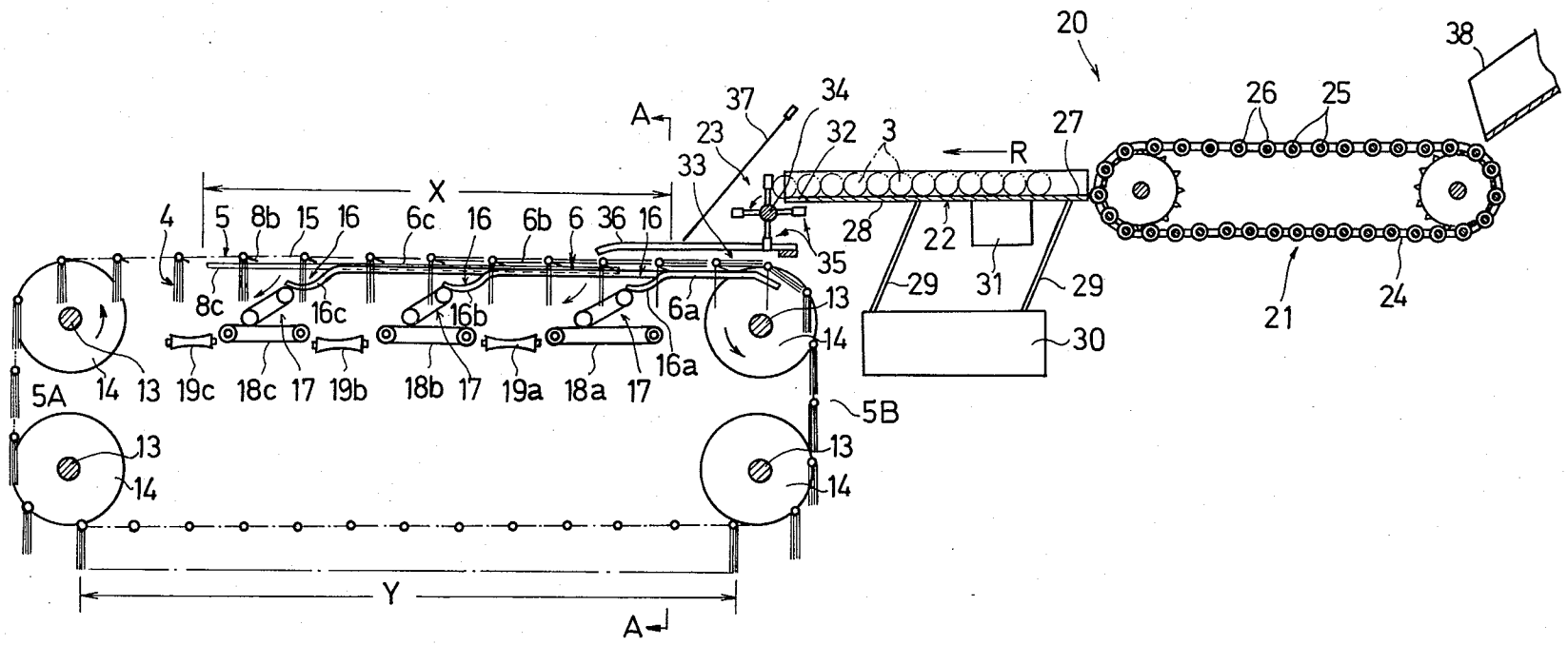
FIG. 2 is a side view showing the whole spherical fruit assorting instrument of the invention.
Figure 5:
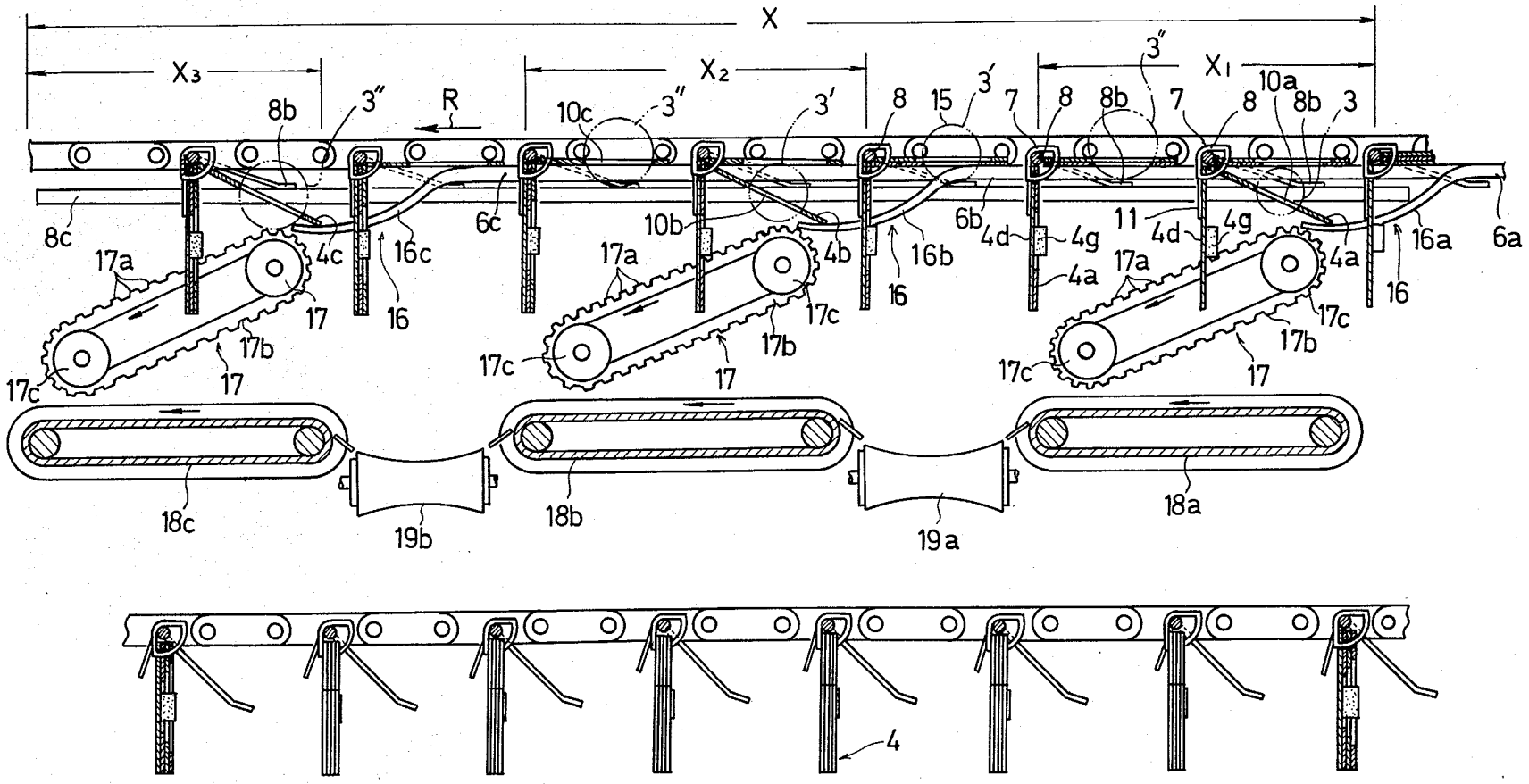
FIG. 5 is a cross sectional view taken on the line B—B of FIG. 4.

Said guide arms 8*b* are disposed so as to control and permit the axis 8*a* to slide on the upper suface area of guide rails 8*c* which are disposed in parallel relation with one another in the outside of the chain means 15. Said guide rails 8*c* are positioned in assorting area within which the assorting plate members move downward, as shown in FIGS. 2 and 5, wherein said stopper means 11 is prevented from moving in the direction of the conveyor means.

Said guide means 6 comprise a first group of guide rods 6*a*, a second group of guide rods 6*b* and a third group of guide rods 6*c* all disposed in parallel relation with said endless conveyor means 5 bilaterally of an assorting area X in such a manner that the extremities of the rods directed toward the movement of the endless conveyor means 5 are continuously overlapped with each other and further that the distance between the guide rods increases toward the direction of said movement, as is clearly illustrated in FIG. 4 of the accompanying drawings.

For a fuller understanding, said first group of guide rods 6*a* are disposed to be engageable with the lower surfaces of said projections 9*a* bilateral of said assorting plate members 4*a* placed in the lowermost position of each assorting plate 4. Said second group of guide rods 6*b* are disposed to be engageable with the projections 9*b* bilateral of said assorting plate member 4*b*. Likewise, said third group of guide rods 6*c* are disposed to be engageable with the projections 9*c* of said assorting plate member 4*c*.

Figure 6:
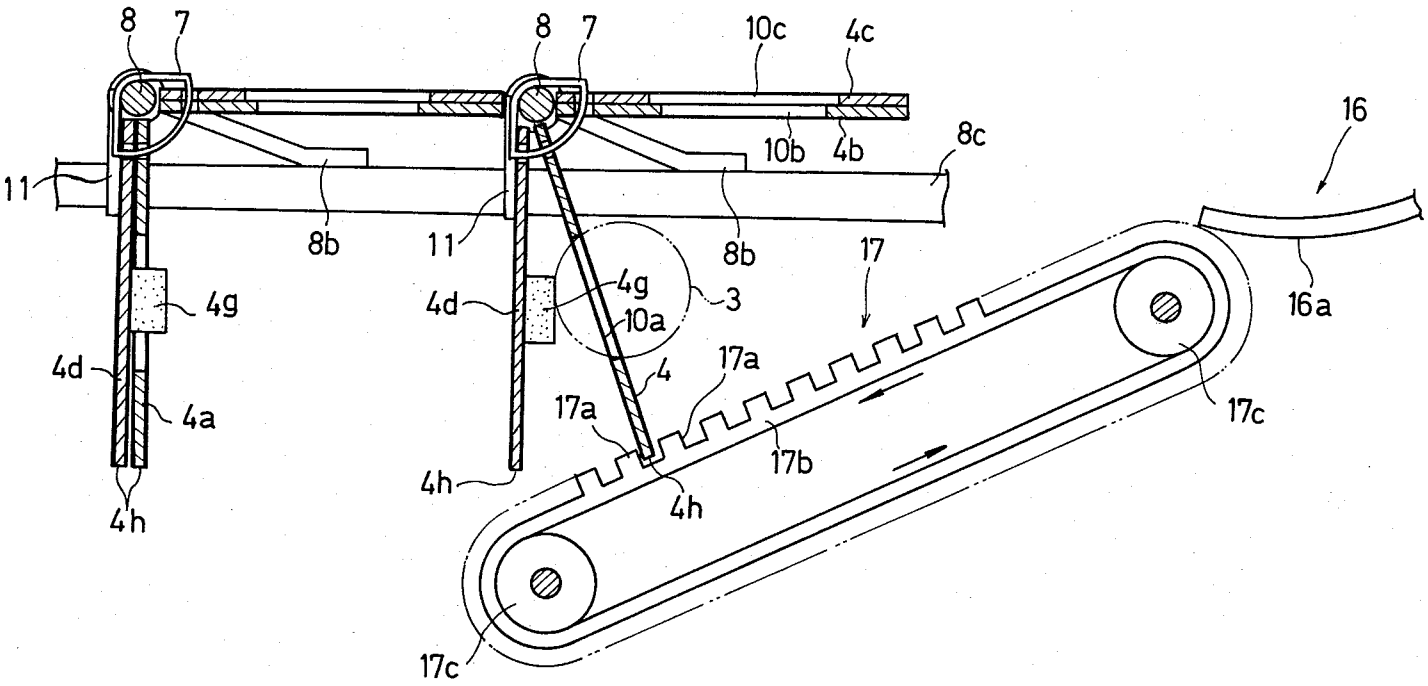
FIG. 6 is a diagram showing the manner in which the assorting plates operate during their downward movement.

A reduction means 16 shown in FIG. 6 comprises guide members 16*a*, 16*b* and 16*c* which are curved downwardly in the foremost end of the above-mentioned guide rods 6*a*, 6*b* and 6*c*, being adapted that said foremost end thereof are made gradually to move down in slidable relation with the curvature of said guide members thereby being permitted to come down at a lower rate than the rotational speed at which otherwise said foremost ends might do.

According to the present embodiment of the invention, there is employed a pressing means 17 for pressing the downward rotating assorting plate members 4*a*, 4*b* and 4*c* against the auxiliary receiving plate 4*d*. Said pressing means 17 are provided in conveyance sections X1, X2 and X3, respectively, wherein said assorting plate members 4*a*, 4*b* and 4*c* are moved downward after going through the reduction means 16.

Further said pressing means 17 is formed with an endless rubber belt 17*b* which is provided in the outer circumference thereof with a plurality of projections 17*a* and mounted on an incline by pulleys 17*c*, being adapted to be engageable with the lowermost edge of the assorting plate members when they have moved down under the guidance of the curved guide or a reduction means 16 so that said assorting plate members are made to move at such a rate as can be pressed against the throughholes of either the auxiliary receiving plates 4*d* conveying said assorting plate members in vertical relation or these assorting plate members which have moved down in sequence, as is clearly illustrated in FIG. 6 of the accompanying drawings.

Below each of said assorting plate members 4*a*, 4*b* and 4*c*, there is provided a belt conveyor means 18*a*, 18*b* or 18*c* for receiving the fruits 3 that come down from said members and convey the same toward the direction where the fruits 3 are to be conveyed. In the foremost end of each conveyor belt 18*a*, 18*b* or 18*c* there is further provided a conveyor belt 19*a*, 19*b* or 19*c* for sending said fruits 3 to the flanks of said belt.

In FIGS. 1 and 2 reference numeral 20 denotes a supplying source means that comprises roller conveyor 21, vibrating conveyor 22 and feeding mechanisms 23.

Said roller conveyor 21 comprises a bilateral pair of parallel chain conveyor members 24, bars 25 mounted thereinto at regularly spaced apart intervals and cylindrical free rollers 26 rotatably mounted on the outer circumference of the bars 25.

Said vibrating conveyor 22 comprises a plurality of lineal grooves 27 formed on the upper surface area of a conveying member 28, being adapted to receive a quantity of fruits 3 fed by means of the roller conveyor 21 and form the same in line, said conveying member 28 mounted on the top of a pair of spring means 29 extending upwardly in an inclined direction from a platform 30, a vibrating source 31 such as an electric motor that serves to agitate and move the fruits 3 along said lineal grooves 27 in the direction shown by the arrow R in FIG. 2, and holes 32 provided in each outlet of said grooves.

Figure 3:
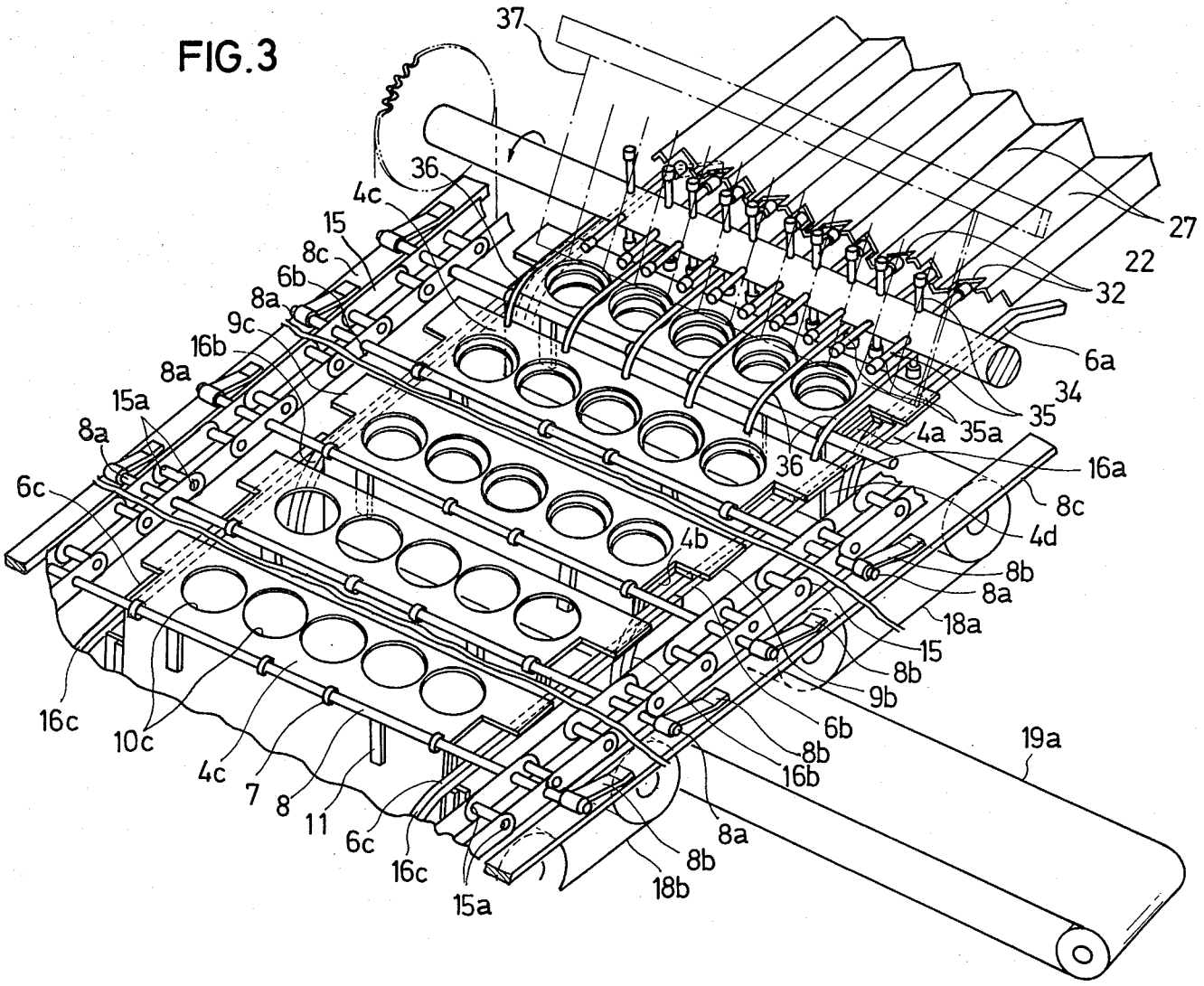
FIG. 3 is a perspective view showing a fruit supplying portion of the spherical fruit assorting instrument of the invention.

Said feeding mechanism 23 is formed with hoisting members 35 each comprising arms 35*a* as shown in FIG. 3, disposed in parallel with one another at equally spaced apart interval along a rotary shaft 34 which is disposed above a fruit feeding position 33 and circumferentially corresponds to the passage of said assorting throughholes 10*a*, 10*b* and 10*c*.

Said arms 35*a* are disposed to move along with the rotation of the rotary shaft 34, each of which moves through each of said holes 32 provided on said each groove 27 of the conveying member 28.

Midway between said hoisting members 35 there are partitioning rods 36 rigidly fixed below and across the rotary shaft 34 in a manner that said rods 36 are positioned in correspondence to the upper surface area midway of each throughhole of the assorting plates 4.

Said rotary shaft 34 is adapted to rotate through the chains 5 and the sprocket wheels 14 with respect to the endless conveyor belt 2 so that a quantity of fruits 3 between the hoisting members 35 in the outer circumference of the rotary shaft 34 are permitted to fall down in regular order through the assorting holes 10*a*, 10*b* and 10*c*.

On the outer peripheral surface of the rotary shaft 34 there is provided a rubber abutting plate 37 for limiting the forward motion of fruits 3. A chute 38 is provided from which a quantity of fruits 3 are to be fed to the supplying source means 20.

Description will now be made of the mode of operation of the spherical fruit assorting instrument described in accordance with the above-mentioned embodiment of the present invention.

A quantity of fruits 3 to be assorted are fed from the chute 38 onto the roller conveyor 21 of the supplying source means 20, said quantity are accumulated on the upper surface area of free rollers 26 that are rotating respectively round the axis thereof. The fruits 3 are dispersed due to the rotation of the free rollers 26 when the fruits 3 fall under gravity on rollers which collectively define an upper surface area. The fruits 3 are then guided to move to the upper surface area of the conveying member 28 of the vibrating conveyor 22. In this case, a quantity of fruits 3 are caught into each groove 27 on the upper surface of the conveying member 28 and form a plurality of linear arrays. Then the foremost quantity of the fruits 3 are disposed in regular sequence between the hoisting members 35 of the feeding mechanism 23 and rotated along with the rotation of the rotary shaft 34 to be fed in order through the throughholes 10*a*, 10*b* and 10*c* of the assorting plates 4 of the endless conveyor belt 2 passing below the throughholes, thereafter being conveyed forward along with the assorting plates 4.

In this case, the auxiliary receiving plates 4*d* are being conveyed forward between the assorting zone X subject to the stopper means 11, the latter prevented from moving by means of the guide rails 8 and the guide arms 8*b*.

After the assorting plates 4 loaded with a quantity of fruits 3 have reached the conveyance section X1 of the assorting zone X and gone through the first group of guide rods 6*a*, the plates 4 then move along with the curved guides 16*a* of the reduction means 16. In this case, the extremities of the assorting plate members 4*a* are gradually made of go down in touch with said members 4*a* so that the latter members are rotated at a lower rate than the rotational speed at which they can fall down by their own gravity. Thus even if some of the fruits 3 go through to the side of the auxiliary receiving plates 4*d*, namely in the reverse direction rather than most of the fruits 3 normally go through, they are permitted to fall down before the assorting plate members 4*a* fall down, thus being prevented from getting caught between the plates 4*d* and 4*a*.

Successively, the lowermost edge of the assorting plate members 4*a* is brought into engagement with a projection 17*a* of the rubber belt 17*b* of the pressing means 17 and forced to be moved toward the auxiliary receiving plate 4*d* at a higher rate than the endless conveyor mechanism 5. However, inasmuch as the auxiliary receiving plate 4*d* is held not to move forward by means of the stopper means 11, the shock-absorbing element 4*g* of the plate 4*d* works to push out the fruits 3 even if they are tightly caught into the assorting throughholes 10*a*, thus permitting the fruits 3 to fall down. Ths prevents failure in assorting due to the fruits 3 being either caught into the throughholes or to the timelag when the fruits 3 fall down.

The quantity of fruits 3 that have thus fallen down from the assorting plate members 4*a* are sent to the flanks of the assorting instrument through a conveyor belt 18*a* and a narrow conveyor belt 19*a* both disposed below the assorting plate members 4*a*.

In the meanwhile, some fruits 3' which are greater in diameter than the throughholes 10*b* of the assorting plate member 4*b* but smaller in diameter than the throughholes 10*c* of the assorting plate member 4*c* are caught into the throughholes 10*b* of the assorting plate member 4*b* and move along with the assorting plate 4 without being permitted to fall down during the course of the conveyance section X1. Then in the following conveyance section X2, said quantity 3' are permitted to move down just when they go through the second group of guide rods 6*b* and fall down from the throughholes 10*b*, as is the case with the assorting plate member 4*a*. Some of the fruits 3' still tightly caught in the throughholes 10*b* are forcibly taken off by means of the pressing means 17.

Furthermore, a quantity of fruits 3'' which are greater in diameter than the throughholes 10*c* of the assorting plate member 4*c* are caught into the throughholes 10*c*, moving to the following conveyance section X3 along with the assorting plate 4 without being permitted to fall down while going through the conveyance section X3. When said quantity 3'' have gone through the third group of guide rods 6*c*, they are permitted to fall down while moving downwardly, as is the case with the assorting plate members 4*a* and 4*b* mentioned above. Some of the fruits 3'' still tightly caught in the throughholes 10*c* are forcibly taken off by means of said pressing means 17.

All the foregoing assorting plate members 4*a*, 4*b* and 4*c* are conveyed back through a back course Y to a rear end 5B of the endless conveyor belt 5 after having moved down in a suspended state and gone through a front end 5A thereof.

Likewise, all the assorting plates 4 following are conveyed along the course of the assorting zone X, with the assorting plate members positioned at a lower level being moved down in sequence. The result is that the fruits 3 are permitted to fall down in different positions to be assorted in accordance with different diameters.

While the invention has been described only with respect to the assorting plate 4 in combination of three assorting plate members 4*a*, 4*b* and 4*c* with a single auxiliary receiving plate 4*d*, it will be clearly understood from the attached claims that said members are not limited in number and that the throughholes of said assorting plate members are not limited to a round shape only.

What is claimed is:

1. A spherical fruit assorting instrument comprising:
(a) an endless conveyor;
(b) a plurality of spaced shafts carried by the conveyor;
(c) a plurality of assorting plates pivotally carried by each shaft, with the assorting plates being provided with throughholes which decrease in diameter from the uppermost assorting plate to the lowermost assorting plate when the assorting plates are collectively disposed in a horizontal disposition;
(d) means for maintaining the assorting plates in the horizontal disposition;
(e) guide means for permitting the assorting plates of each shaft to sequentially pivot downwardly about the shaft during movement of the conveyor;
(f) a receiving plate pivotally carried by each shaft and disposed beneath the lowermost assorting plate for releasing fruits from the assorting plates;
(g) shock absorbing means carried by each receiving plate and aligned with the throughholes of its corresponding assorting plate; and
(h) stopper means carried by each shaft for limiting the pivotal movement of the receiving plate and maintaining same in a vertical disposition.

2. A spherical fruit assorting instrument comprising:
(a) an endless conveyor;
(b) a plurality of spaced shafts carried by the conveyor;
(c) a plurality of assorting plates pivotally carried by each shaft, with the assorting plates being provided with throughholes which decrease in diameter from the uppermost assorting plate to the lowermost assorting plate when the assorting plates are collectively disposed in a horizontal disposition;
(d) means for maintaining the assorting plates in the horizontal disposition;
(e) guide means for permitting the assorting plates of each shaft to sequentially pivot downwardly about the shaft during movement of the conveyor;
(f) a receiving plate pivotally carried by each shaft and disposed beneath the lowermost assorting plate for releasing fruits from the assorting plates; and
(g) reduction means associated with the conveyor for reducing the speed at which the assorting plates pivot downwardly about the shaft to below that realized under the effect of gravity.

3. A spherical food assorting instrument comprising:
(a) an endless conveyor;
(b) a plurality of spaced shafts carried by the conveyor;
(c) a plurality of assorting plates pivotally carried by each shaft and each plate including opposed extensions, with the assorting plates being provided with throughholes which decrease in diameter from the uppermost assorting plate to the lowermost assorting plate when the assorting plates are collectively disposed in a horizontal disposition;
(d) means for maintaining the assorting plates in the horizontal disposition;
(e) guide means for permitting the assorting plates of each shaft to sequentially pivot downwardly about the shaft during movement of the conveyor, with the guide means including curved portions for contacting the opposed extensions of the assorting plates; and
(f) a receiving plate pivotally carried by each shaft and disposed beneath the lowermost assorting plate for releasing foods from the assorting plates.

4. A spherical fruit assorting instrument comprising:
(a) an endless conveyor;
(b) a plurality of spaced shafts carried by the conveyor;
(c) a plurality of assorting plates pivotally carried by each shaft, with the assorting plates being provided with throughholes which decrease in diameter from the uppermost assorting plate to the lowermost assorting plate when the assorting plates are collectively disposed in a horizontal disposition;
(d) means for maintaining the assorting plates in the horizontal disposition;
(e) guide means for permitting the assorting plates of each shaft to sequentially pivot downwardly about the shaft during movement of the conveyor;
(f) a receiving plate pivotally carried by each shaft and disposed beneath the lowermost assorting plate for releasing fruits from the assorting plates; and
(g) means for pressing the assorting plates against their correponding receiving plates.

5. The instrument of claim 4 wherein the pressing means includes:
(a) a plurality of inclined endless conveyor belts;
(b) a pair of pulleys for supporting and moving each endless conveyor belt; and
(c) a plurality of projections carried on the outer surface of each endless conveyor belt for receiving and pressing the assorting plates against their corresponding receiving plate.

* * * * *